US009212611B2

(12) United States Patent
Panciroli et al.

(10) Patent No.: US 9,212,611 B2
(45) Date of Patent: Dec. 15, 2015

(54) METHOD FOR CONTROLLING THE MOVEMENT OF A COMPONENT THAT MOVES TOWARDS A POSITION DEFINED BY A LIMIT STOP IN AN INTERNAL COMBUSTION ENGINE

(75) Inventors: Marco Panciroli, Bologna (IT); Stefano Sgatti, Imola (IT)

(73) Assignee: MAGNETI MARELLI S.PA., Corbetta (IT)

( * ) Notice: Subject to any disclaimer, the term of this patent is extended or adjusted under 35 U.S.C. 154(b) by 91 days.

(21) Appl. No.: 12/979,788

(22) Filed: Dec. 28, 2010

(65) Prior Publication Data

US 2011/0166766 A1 Jul. 7, 2011

(30) Foreign Application Priority Data

Dec. 28, 2009 (IT) ..... BO2009A0831

(51) Int. Cl.

| | |
|---|---|
| ***F01L 9/04*** | (2006.01) |
| ***F02D 35/02*** | (2006.01) |
| ***F01L 1/46*** | (2006.01) |
| ***F01L 9/02*** | (2006.01) |
| *F02D 41/14* | (2006.01) |
| *F02D 41/28* | (2006.01) |
| *F01L 1/08* | (2006.01) |
| *F01L 1/34* | (2006.01) |
| *F01L 1/053* | (2006.01) |
| *F02D 41/00* | (2006.01) |
| *F01L 13/00* | (2006.01) |

(52) U.S. Cl.

CPC . *F02D 35/02* (2013.01); *F01L 1/46* (2013.01); *F01L 9/025* (2013.01); *F01L 1/08* (2013.01); *F01L 1/34* (2013.01); *F01L 9/04* (2013.01); *F01L 2001/0537* (2013.01); *F01L 2013/11* (2013.01); *F01L 2820/041* (2013.01); *F01L 2820/043* (2013.01); *F01L 2820/045* (2013.01); *F02D 2041/001* (2013.01); *F02D 2041/1432* (2013.01); *F02D 2041/288* (2013.01); *F02D 2200/025* (2013.01)

(58) Field of Classification Search

CPC ..... F01L 9/04; F01L 1/46; F02D 2200/025; F02D 13/0253; F02D 2041/001

USPC ..... 701/102, 103, 114; 73/587, 801, 73/114.77, 114.79; 123/90.15, 90.16, 123/90.48, 90.49; 251/129.03; 702/33, 150, 702/182, 183

See application file for complete search history.

(56) References Cited

U.S. PATENT DOCUMENTS

| | | | | |
|---|---|---|---|---|
| 5,533,477 | A | 7/1996 | Weigl | |
| 7,089,895 | B2 * | 8/2006 | Naber et al. | 123/90.11 |
| 7,155,333 | B1 | 12/2006 | Abram et al. | |

FOREIGN PATENT DOCUMENTS

| | | | |
|---|---|---|---|
| DE | 10 2004 013767 | A1 | 10/2005 |
| DE | 10 2006 061566 | A1 | 7/2008 |
| EP | 0 644 323 | A1 | 3/1995 |
| WO | WO-2008146078 | A1 | 12/2008 |

* cited by examiner

*Primary Examiner* — Hai Huynh

*Assistant Examiner* — Gonzalo Laguarda

(74) *Attorney, Agent, or Firm* — Howard & Howard Attorneys PLLC

(57) ABSTRACT

A method for controlling the movement of a component that moves towards a position defined by a limit stop in an internal combustion engine; the control method comprises the steps of detecting, by means of at least one acoustic microphone, the intensity of the microphonic signal generated by the impact of the component against the limit stop; and determining the impact instant and/or the impact speed of the component against the limit stop by analyzing the intensity of the microphonic signal generated by the impact.

16 Claims, 12 Drawing Sheets

METHOD FOR CONTROLLING THE MOVEMENT OF A COMPONENT THAT MOVES TOWARDS A POSITION DEFINED BY A LIMIT STOP IN AN INTERNAL COMBUSTION ENGINE

CROSS-REFERENCE TO RELATED APPLICATION

This application claims priority under 35.U.S.C. §119 to Italian Patent Application No. B02009A-000831, filed on Dec. 28, 2009 with the Italian Patent and Trademark Office, the disclosure of which is incorporated herein in its entirety by reference.

TECHNICAL FIELD

The present invention relates to a method for controlling the movement of a component that moves towards a position defined by a limit stop in an internal combustion engine.

PRIOR ART

An internal combustion engine comprises at least one cylinder, in which a piston runs with reciprocating motion, which piston is mechanically connected to a drive shaft. The cylinder is connected to an intake manifold by means of at least one intake valve and is connected to an exhaust manifold by means of a at least one exhaust valve. In a traditional internal combustion engine, the position of the intake valves and of the exhaust valves is directly controlled by one or two camshafts which receive motion from the drive shaft.

An innovative internal combustion engine has recently been suggested (commercially known as "Multi-Air") comprising a valve opening control device which controls the intake valves, managing the opening angle and lift thereof so as to use the intake valves to control the delivered torque. The valve opening control device uses a traditional camshaft which receives motion from the drive shaft, and comprises an electrically controlled hydraulic actuator (i.e. controlled by means of a solenoid valve), which is interposed between a stem of the intake valve and the camshaft, for each intake valve. By appropriately controlling each hydraulic actuator, it is possible to adjust the motion transmitted by the camshaft to the intake valve stem, and it is thus possible to adjust the actual intake valve lift. Thus, the action of the control device allows to vary the actual lift of each intake valve independently from the other intake valves, for each cylinder and engine cycle.

In case of problems to the hydraulic circuit which feeds the hydraulic actuators of the valve opening control device, or in case of failure of a hydraulic actuator or a solenoid valve of the valve opening control device, the position of one or more intake valves may not be controlled correctly (typically the intake valve concerned by the malfunction always remains closed). In other words, the opening of the intake valves is not mechanically guaranteed by the mechanical cam, because hydraulic actuators are interposed between the intake valves and the mechanical cam and a malfunction of the hydraulic actuators in the control/feeding chain of the hydraulic actuators which prevents the correct operating of the intake valves is possible.

This type of malfunction never has a destructive effective on the internal combustion engine because in all cases the maximum stroke of an intake valve is always limited by the profile of the camshaft, which is studied to avoid any type of mechanical interference between the intake valves and the pistons. In all cases, this type of malfunction must be diagnosed promptly because it negatively impacts on both the torque generated by the internal combustion engine and on the combustion quality in the cylinders.

In order to diagnose the failed opening of one or more intake valves it has been suggested to associate a position sensor (possibly also of the ON/OFF type, i.e. a micro switch) to each intake valve, which sensor allows to detect the actual position of the corresponding intake valve in real time. However, this solution is very costly, both with regards to costs for purchasing, installing and wiring the position sensors, and because the position sensors must be appropriately insulated to withstand the high temperatures which may be reached in the head zone of an internal combustion engine.

DESCRIPTION OF THE INVENTION

It is the object of the present invention to provide a method for controlling the movement of a component that moves towards a position defined by a limit stop in an internal combustion engine, which control method is free from the drawbacks of the prior art and in particular is easy and cost-effective to implement.

According to the present invention a method for controlling the movement of a component that moves towards a position defined by a limit stop in an internal combustion engine is provided as disclosed in the appended claims.

BRIEF DESCRIPTION OF THE DRAWINGS

The present invention will now be described with reference to the enclosed drawings, which illustrate a non-limitative embodiment thereof, in which.

PREFERRED EMBODIMENTS OF THE INVENTION

Figure 1:
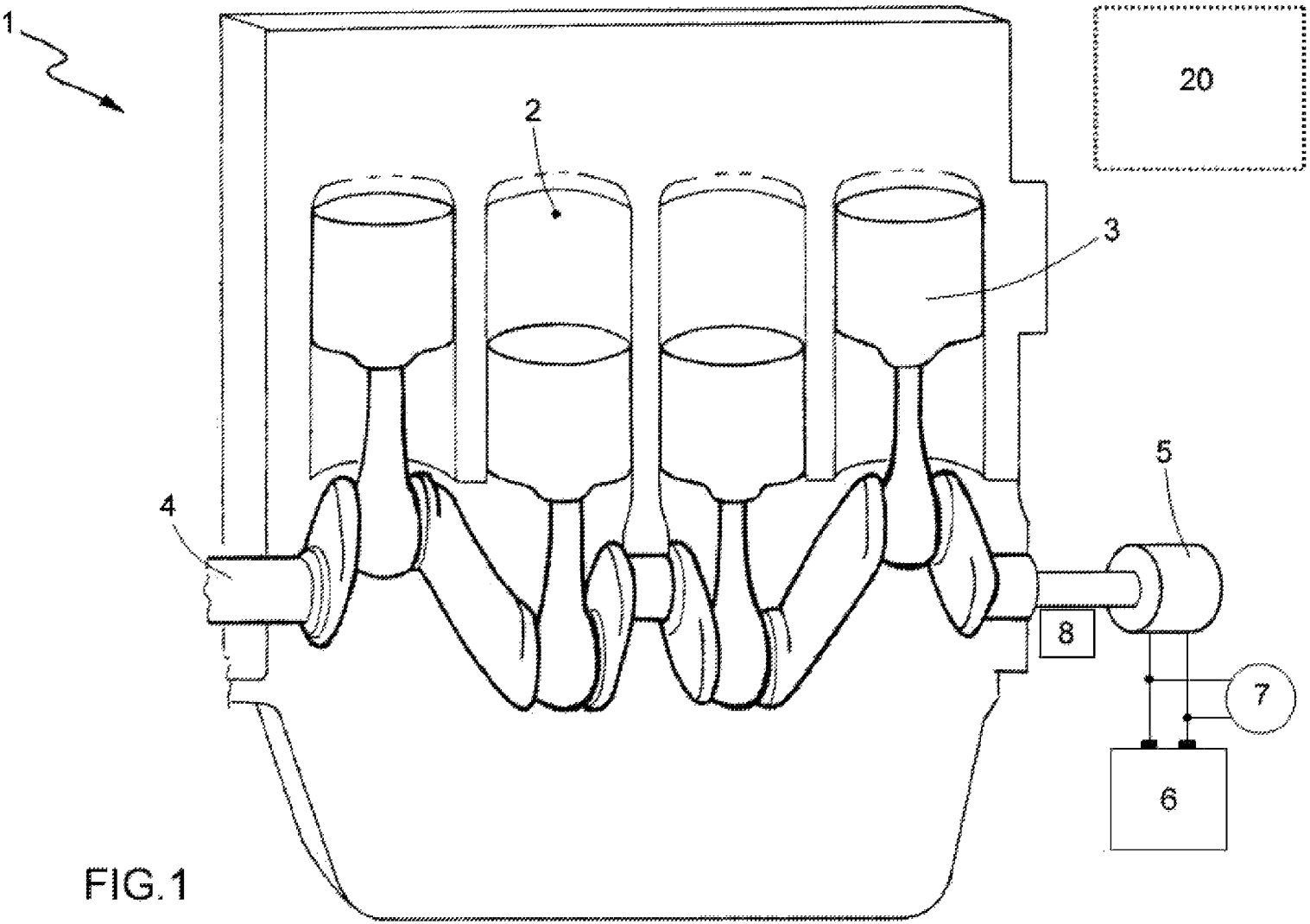
FIG. 1 is a diagrammatic view of an internal combustion engine provided with a control unit which implements the method for controlling the movement of a component that cyclically moves towards a position defined by a limit stop which is object of the present invention.

In FIG. 1, numeral 1 indicates as a whole an internal combustion engine comprising four cylinders 2 in a straight arrangement. Each cylinder 2 comprises a respective piston 3 mechanically connected by means of a connecting rod to a drive shaft 4 for transmitting the force generated by the combustion in the cylinder 2 to the drive shaft 4 itself.

An electric starter motor 5, which is fed by a battery 6 and adapted to rotate the drive shaft 4 to start the internal combustion engine 1, is fitted onto the drive shaft 4. A voltmeter 7, which detects a battery voltage V, is connected to the terminals of the battery 6; furthermore, the drive shaft 4 is coupled to a speed sensor 8 (typically a phonic wheel) which detects a rotation speed ω of the drive shaft 4.

Figure 2:
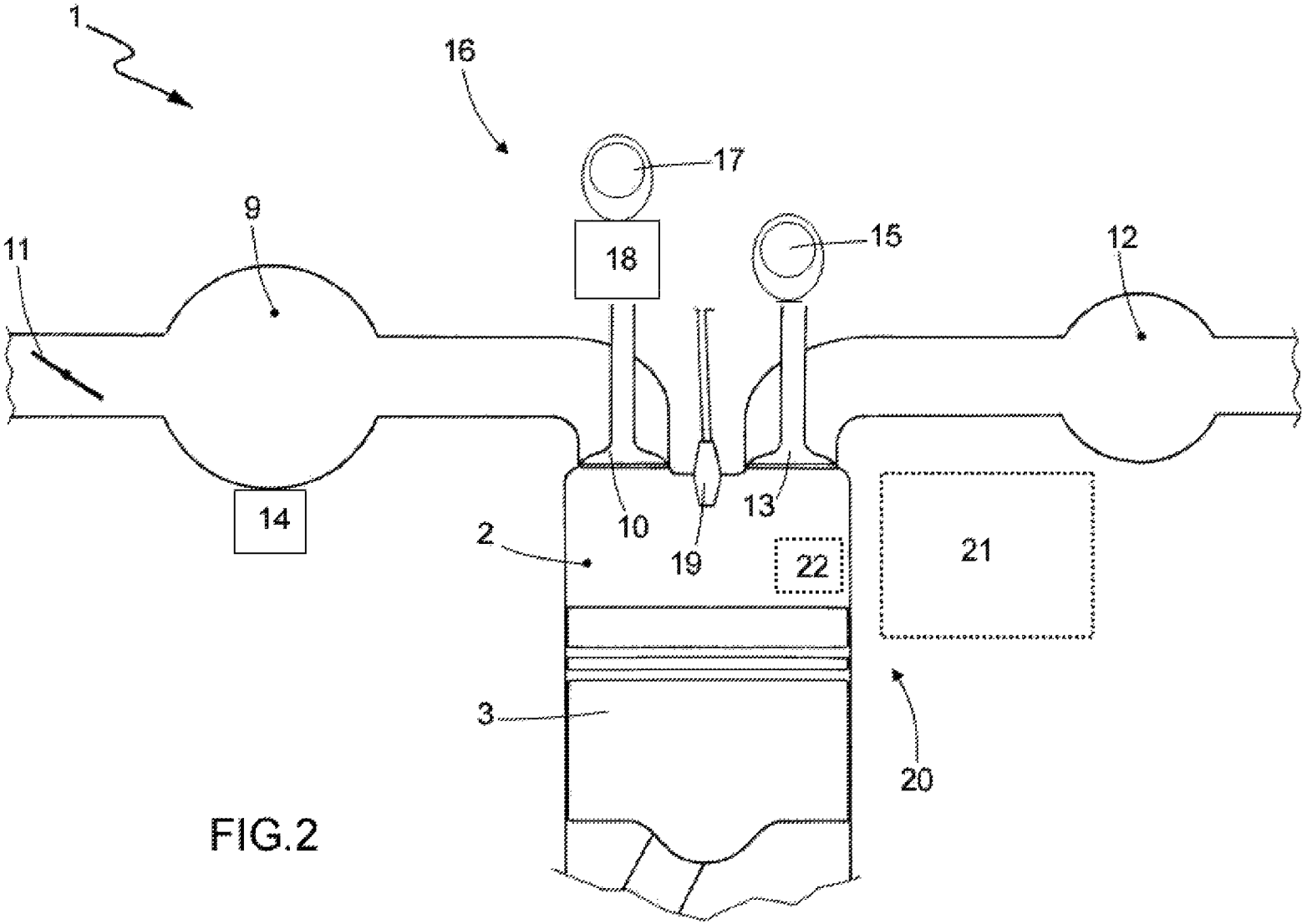
FIG. 2 is a diagrammatic view of a cylinder of the internal combustion engine in FIG. 1.

As shown in FIG. 2, the internal combustion engine 1 comprises an intake manifold 9, which is connected to each cylinder 2 by means of two intake valves 10 (of which only one is shown in FIG. 2) and receives fresh air (i.e. air from the outside environment) through a butterfly valve 11 mobile between a closing position and a maximum opening position. Furthermore, the internal combustion engine 1 comprises an exhaust manifold 12, which is connected to each cylinder 2 by means of at least one exhaust valve 13 which flows into an emission pipe (not shown) to emit the gases produced during combustion into the atmosphere. A pressure sensor 14, which measures an intake pressure P, is arranged in the intake manifold 9.

The position of each exhaust valve 13 is directly controlled by a camshaft 15 which receives motion from the drive shaft 4; instead, the position of the intake valves is controlled by a control device 16, which controls the intake valves 10 managing the opening angle and lift so as to control the torque delivered by means of the intake valves 10. The valve opening control device 16 uses a traditional camshaft 17 which receives motion from the drive shaft 4 and for each intake valve comprises an electrically controlled hydraulic actuator 18 (i.e. controlled by means of a solenoid valve), which is interposed between a stem of the intake valve 10 and the camshaft 17. By appropriately controlling each hydraulic actuator 18, it is possible to adjust the motion transmitted by the camshaft 17 to the intake valve stem 10 and it is thus possible to adjust the actual lift of the intake valve 10. Thus, the action of the control device 16 allows to vary the actual lift of each intake valve 10 independently from the other intake valves 10, for each cylinder 2 and engine cycle.

The internal combustion engine 1 shown in FIG. 2 is of the direct injection type, thus an injector 19, which injects the fuel directly into the cylinder 2, is provided for each cylinder 2. According to a different embodiment (not shown), the internal combustion engine 1 is of the indirect injection type, and thus a corresponding injector 19 is arranged for each cylinder 2 upstream of the cylinder in an intake manifold which connects the intake manifold 9 to the cylinder 2.

Finally, the internal combustion engine 1 comprises a control system 20, which is adapted to govern the operation of the internal combustion engine 1 itself. The control system 20 comprises at least one electronic control unit 21 (normally named "ECU"), which controls the movement of the intake valves 10.

Figure 3:
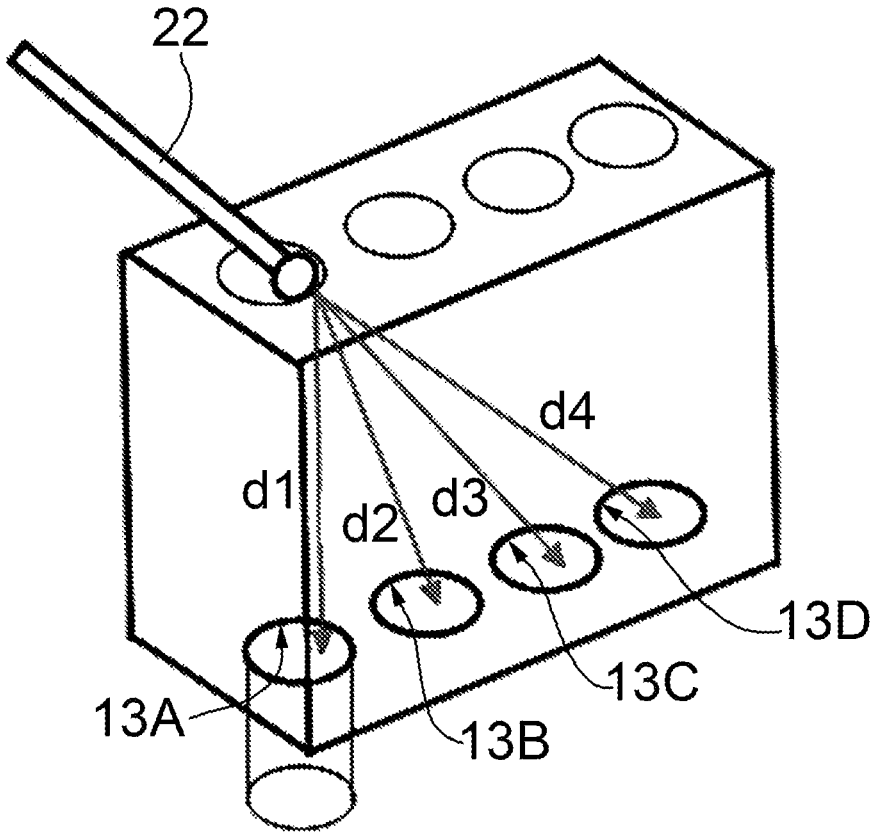
FIG. 3 is a perspective view of a detail in FIG. 1.

As shown in greater detail in FIG. 3, the control system 20 further comprises at least one acoustic pressure level sensor 22, i.e. a microphone 22, which is connected to the electronic control unit 21 and is adapted to detect the intensity S of the microphonic signal, which detects the movement of the engine components, for example the exhaust valves 13.

As shown in greater detail in FIG. 3, the microphone 22 is clearly arranged at different, decreasing distances with respect to the exhaust valves 13 indicated by 13A, 13B, 13C and 13D, each of which is associated to a respective cylinder 2.

The microphone 22 is of the omnidirectional type, but it may alternatively be directional, and in this case it would be obviously oriented towards the exhaust valves 13; furthermore, a relatively high frequency sampling, having a value in the order of size of 100 kHz, is used to acquire the intensity S of the microphonic signal.

Figure 4:
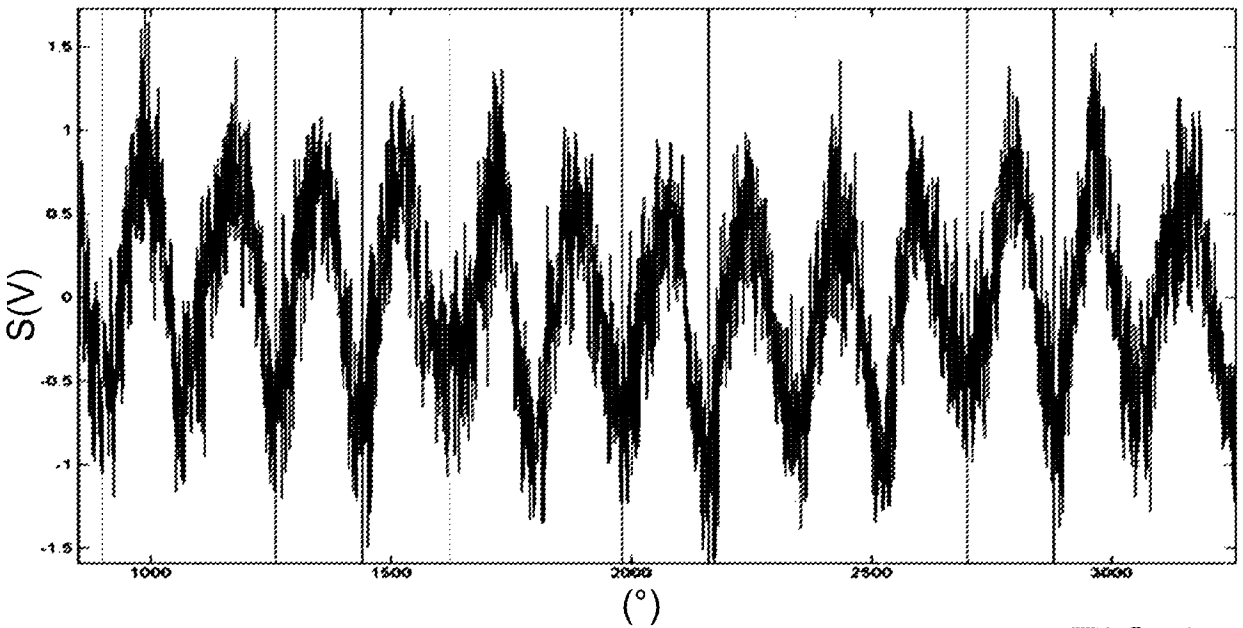
FIG. 4 is a graphic which illustrates the variation of intensity of the microphonic signal according to the engine angle and in predetermined surround conditions.

FIG. 4 shows by way of example a graphic which represents the variation of the intensity S of the microphonic signal which detects the sound content of the internal combustion engine 1, and thus also the actuation of the exhaust valves 13 according to time, which is expressed in engine angle degrees. The graphic in FIG. 4 shows a non-filtered signal which is acquired by the microphone 22 in predetermined surround conditions. Indeed, a signal of the type shown in the graphic in FIG. 4 refers to the conditions of internal combustion engine 1 coasting with the intake valves 10 closed.

During the operating cycle, the intensity S of the microphonic signal generated by the movement of the exhaust valves 13 according to the engine angle is detected by the microphone 22 and memorized in a buffer. As previously shown, a relatively high frequency sample may be used to acquire the intensity S of the microphone signal.

Figure 5:
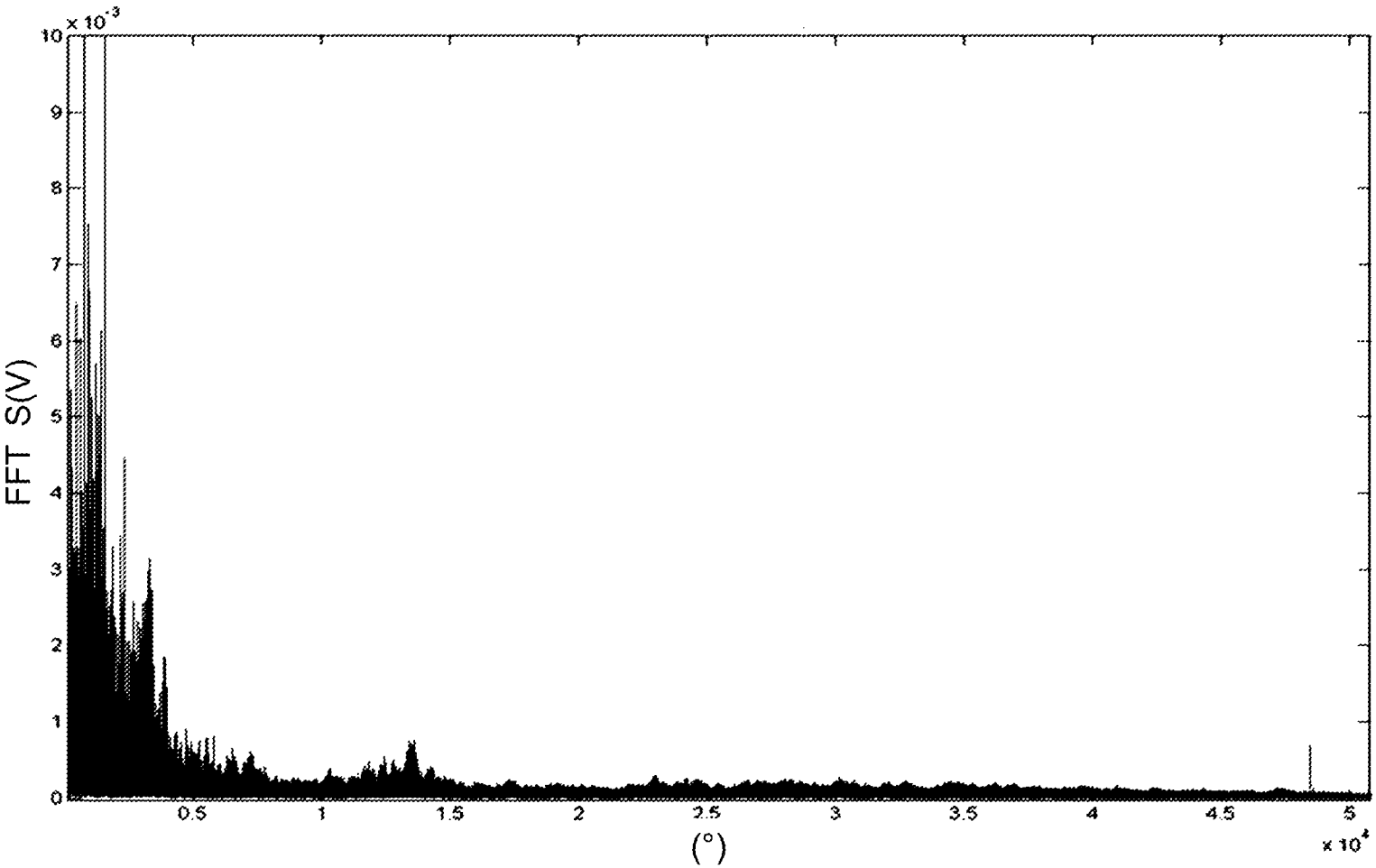
FIG. 5 is a graphic which illustrates the FTT of the intensity of the microphonic signal.

As shown in the graphic in FIG. 4, the signal is rich in information but difficult to correlate to the instant and intensity of striking, i.e. to the impact speed of the closing exhaust valves 13. A Fast Fourier Transform (FTT) must be operated to obtain this information in order to break the obtained signal down into a sum of harmonics with different frequencies, extensions and phases as shown in the graphic in FIG. 5. Two detection windows W and V expressed in engine angle degrees must be determined in order to determine which frequencies are associated to the striking generated by the closing of the exhaust valves 13.

Figure 6:
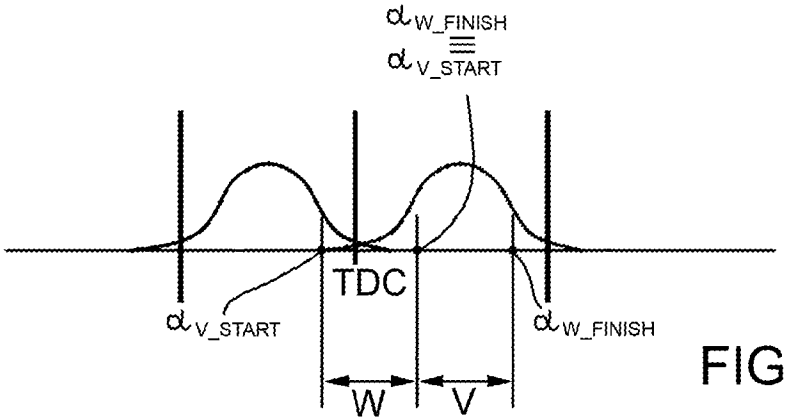
FIG. 6 shows a detail of the graphic in FIG. 5 with two detection windows highlighted.

As shown in FIG. 6, the detection window W has a start engine angle or $\alpha_{w_start}$, which corresponds to a −15° engine angle with respect to the upper combustion top dead centre TDC of the respective cylinder 2, and a finish engine angle $\alpha_{w_finish}$, which corresponds to a +75° engine angle with respect to top dead centre TDC. The detection window W is thus centered about top dead centre TDC.

The detection window V has a start engine angle $\alpha_{v_start}$, which corresponds instead to a +75° engine angle with respect to top dead centre TDC (and thus coinciding with the finish engine angle or $\alpha_{w_finish}$ of the detection window W) and a finish engine angle $\alpha_{v_finish}$, which corresponds to a +165° engine angle with respect to top dead centre TDC. The detection window V is a neutral detection window, so to speak, because it covers an interval expressed in engine degrees far away from the closing of the exhaust valves 13.

Once defined the extension of the two detection windows W and V, a Fast Fourier Transform (FTT) is operated to break down the signal related to the two detection windows W and V. By comparing the signal related to the detection window W and the signal related to the detection window V it is possible to determine which frequencies are associated to the striking generated by the movement of the exhaust valves 13.

Figure 7:
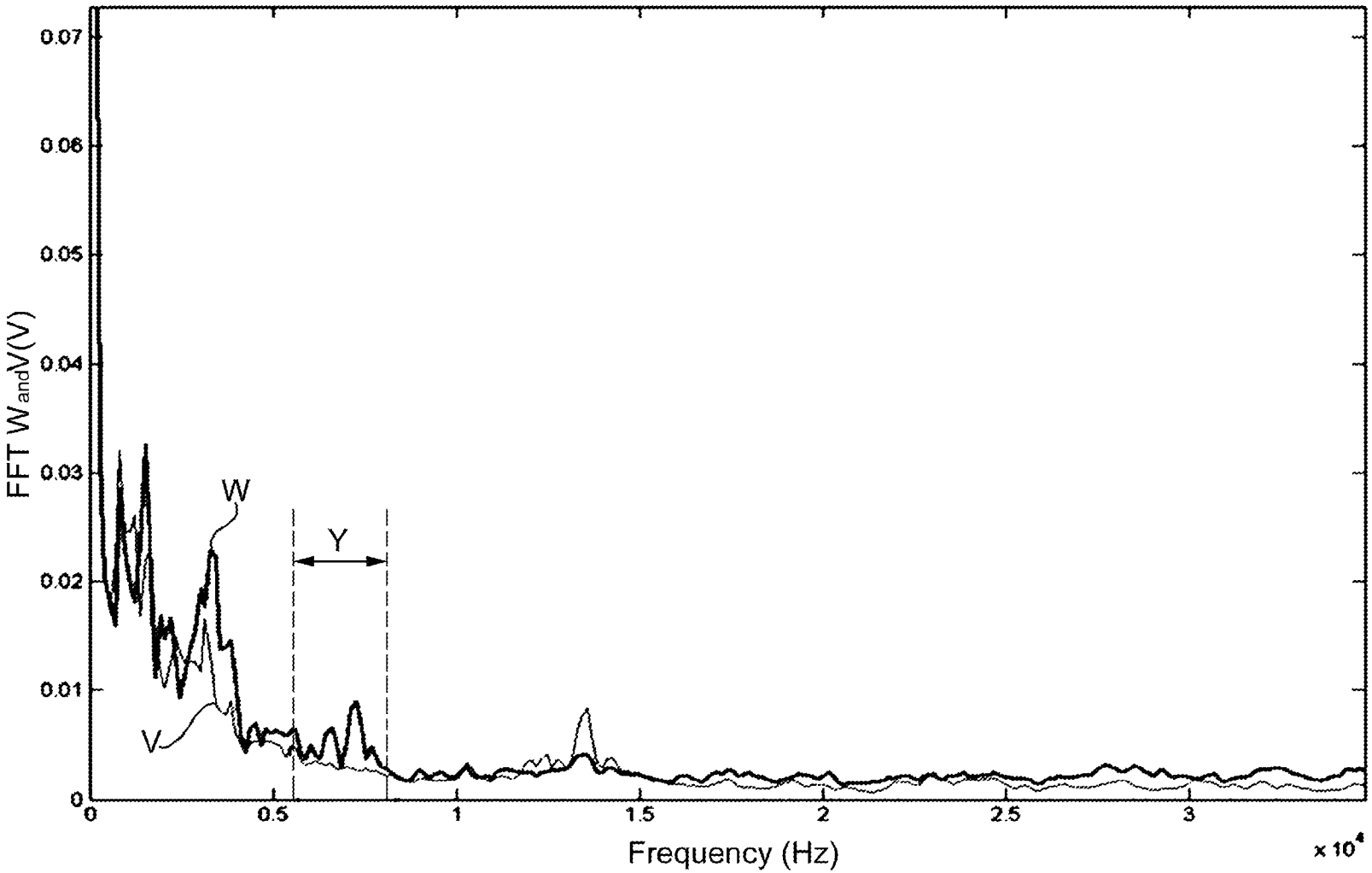
FIG. 7 is a graphic which illustrates the FTT of the intensity of the microphonic signal in the two detection windows.

As better shown in the graphic in FIG. 7, an analysis window Y is identified, which corresponds to the window of frequencies which can be associated to the striking of the closing exhaust valves 13 thus impacting against a respective limit stop producing a vibration. This analysis window Y is comprised, in the example shown in FIG. 7, in the range from 5.5 to 8.5 kHz.

Figure 8:
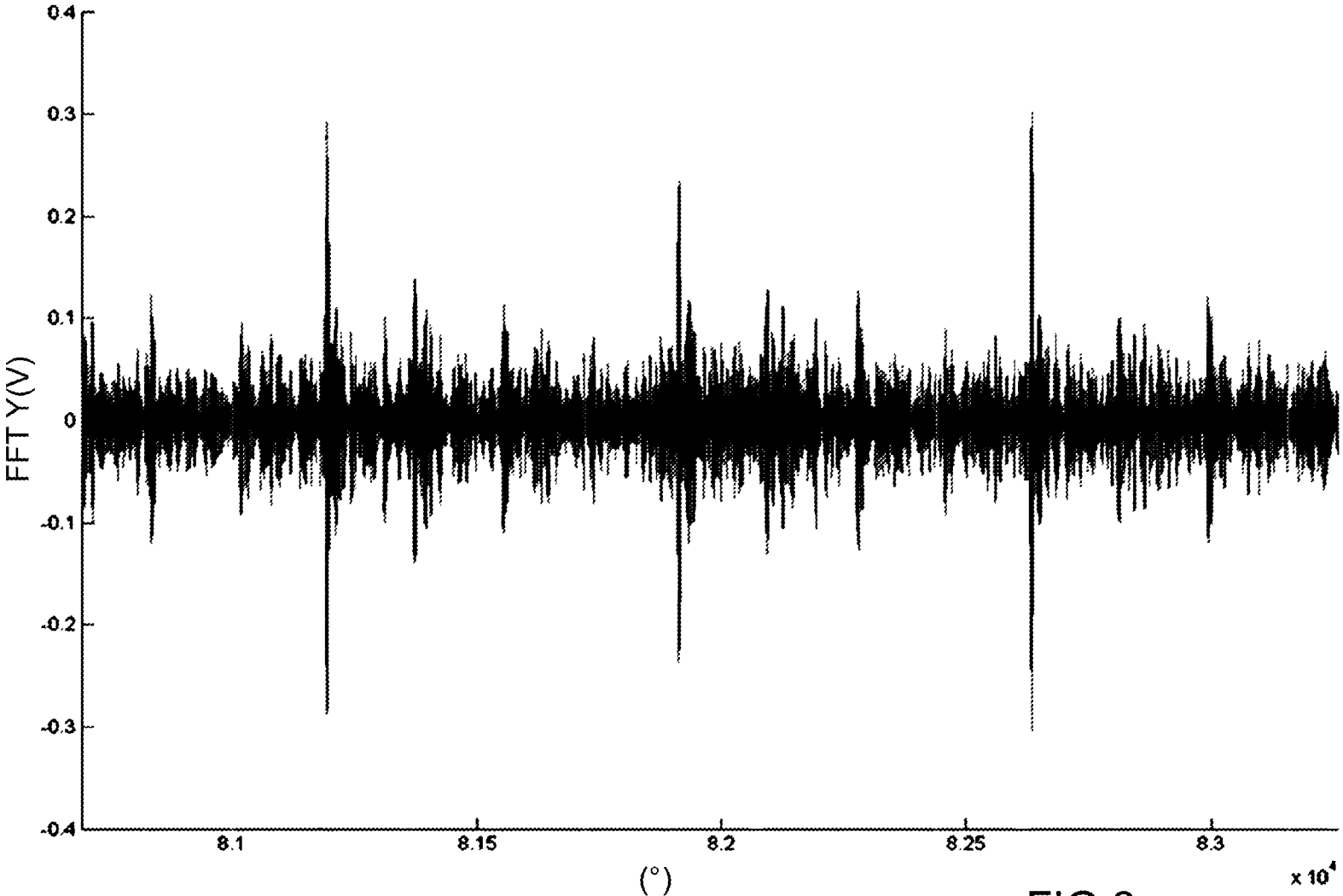
FIG. 8 is a graphic which illustrates the intensity of the microphonic signal after a band-pass type filtering operation in an analysis window.

Next, FIG. 8 shows a graphic which illustrates the FFT of the intensity S of the microphonic signal detected in the analysis window Y with a band-pass filtering which may be applied so as to analyze only the part of the signal richest in information.

The signal which is obtained allows to associate the striking generated by the closing of an exhaust valve 13 to the closing instant, expressed in engine angle degrees. The signal which is obtained contains more information; indeed, the extension of the signal is wider the nearer the exhaust valve 13 is to the microphone 22, as will be better described below.

It is hereafter described the method used by the control unit 21 to detect the instant and/or speed of the impact generated by the closing of the exhaust valves 13 by analyzing the power P of the signal filtered in the analysis window Y.

After having determined the power P of the filtered signal, an upper threshold value UTV for the power P of the filtered signal calculated in the previous step is determined. The graphic shown in FIG. 9 shows the pattern of the power P of the filtered signal and the upper threshold UTV value, which is determined according to the speed.

Figure 9:
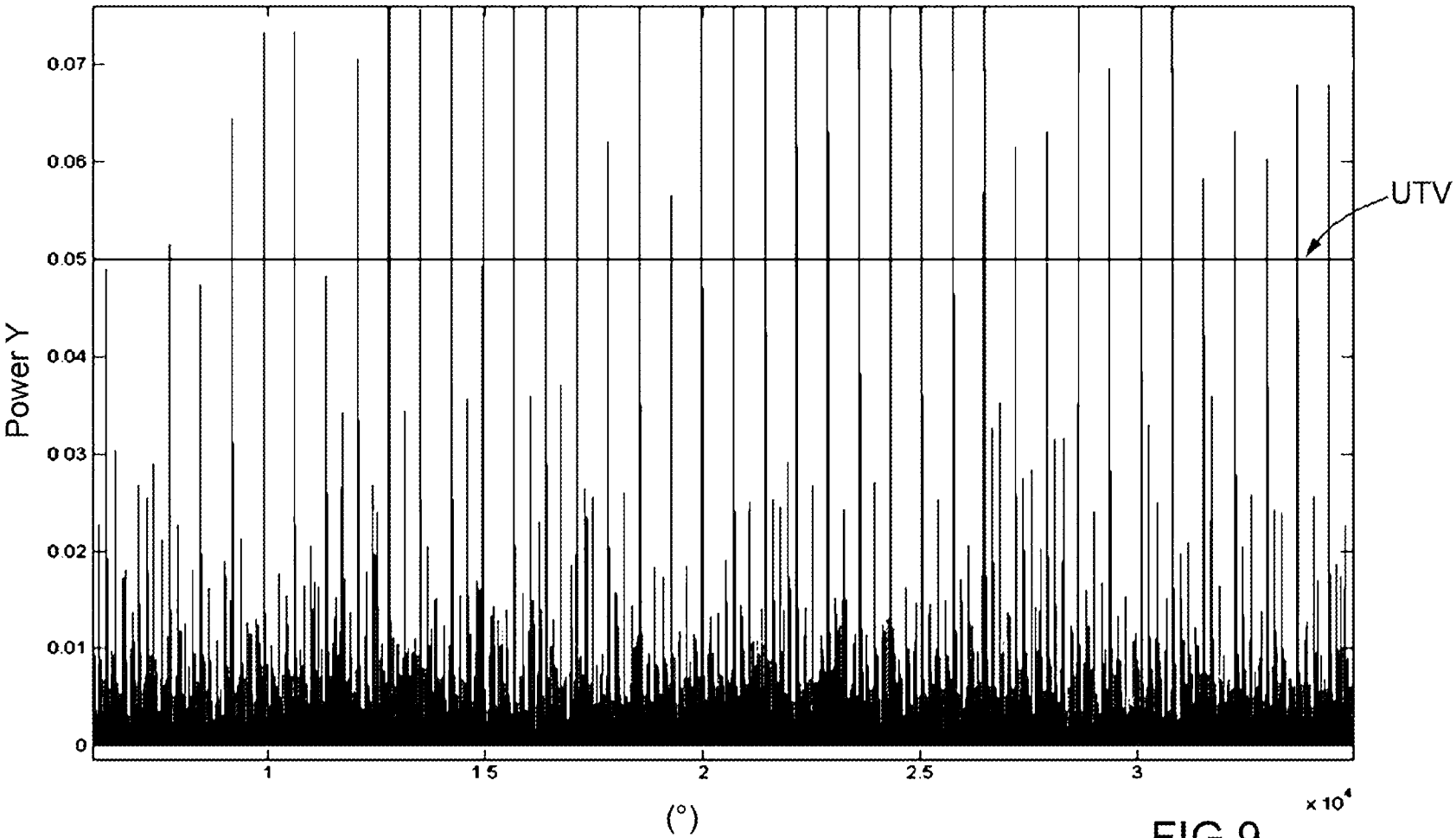
FIG. 9 is a graphic which illustrates the power of the microphonic signal within the analysis window filtered by band-pass operation and identifies an upper threshold value.
Figure 10:
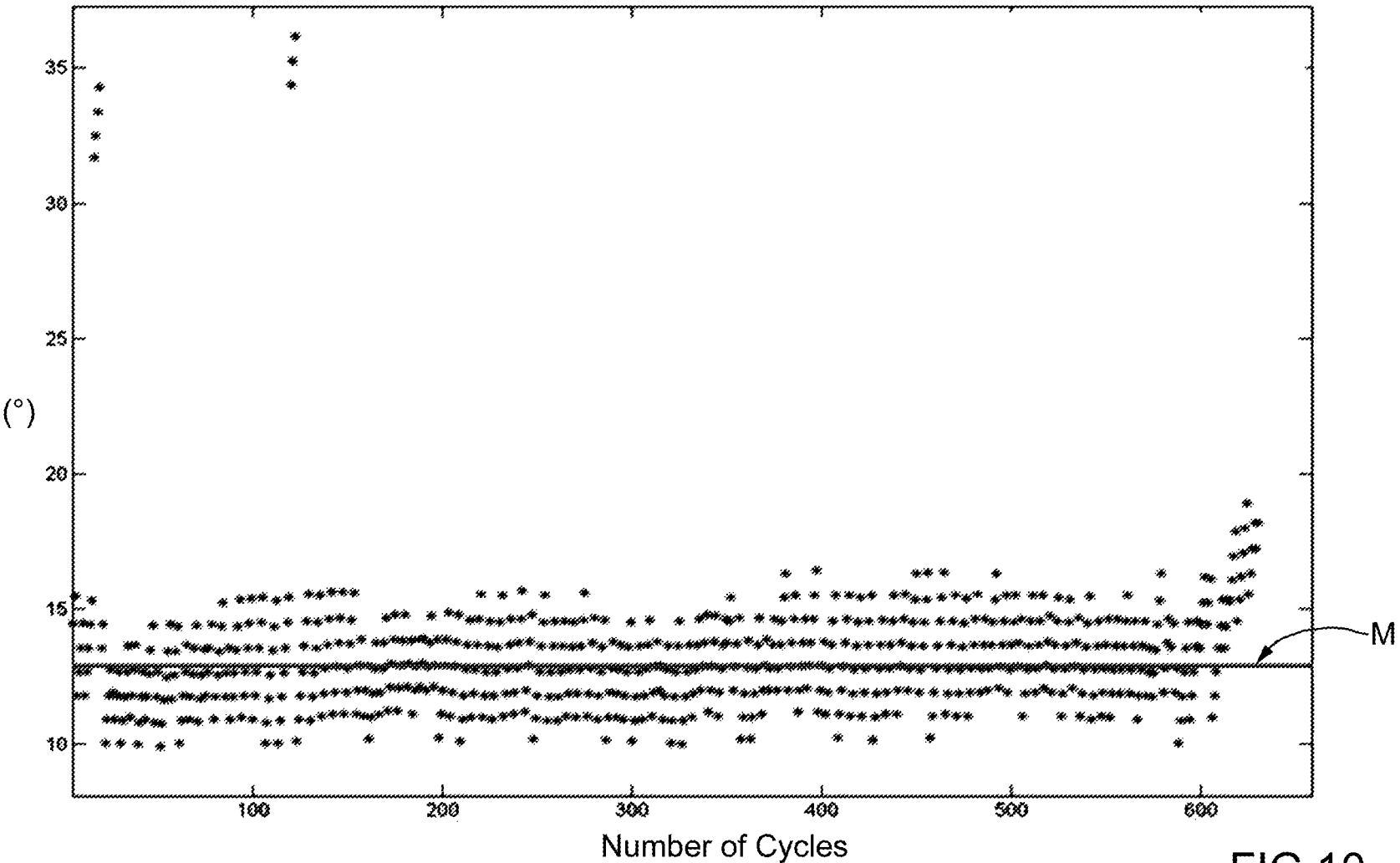
FIGS. 10, 11 and 12 are three graphics which illustrate the steps for determining the median and the mean value of the higher values of the upper threshold value in sequence.
Figure 11:
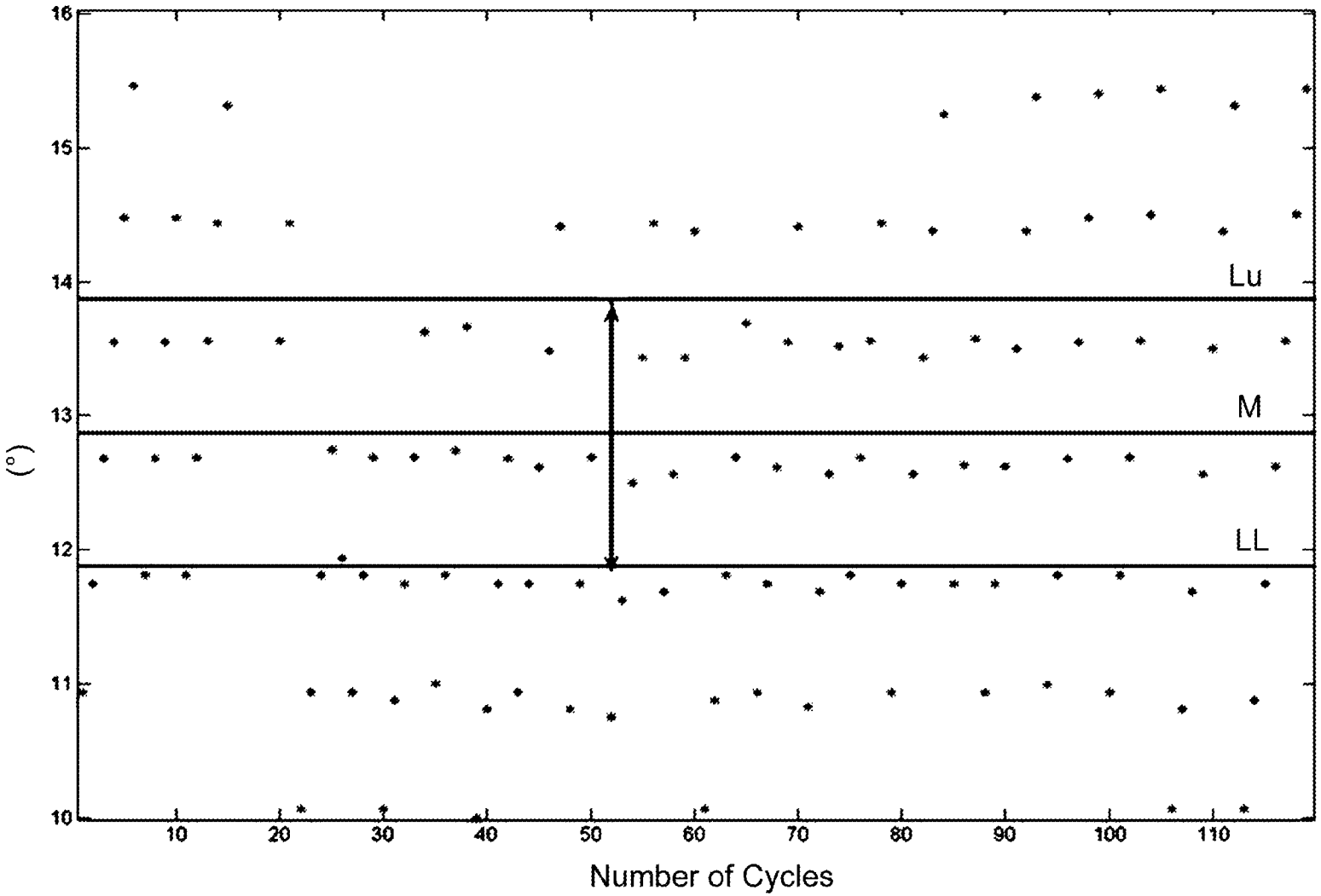
Figure 12:
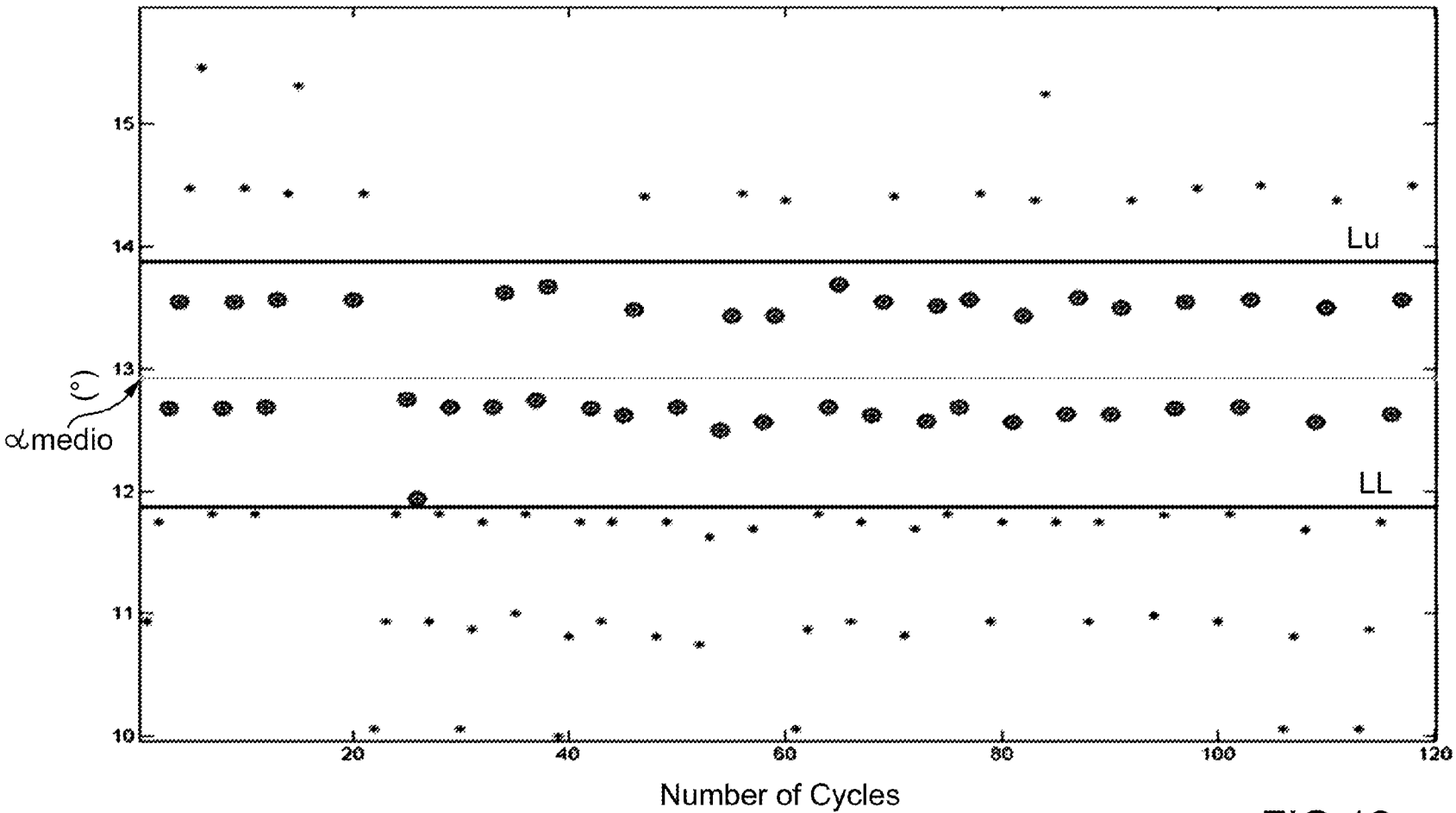

At this point, the engine degree values are identified in the graphic in FIG. 9, to which a power signal P higher than the upper threshold value UTV corresponds. The median M, i.e. the value of power P, which halves the sorted distribution of the set of values assumed in the previous step, i.e. the power values P higher than the upper threshold value UTV, is determined.

A range of values is obtained, which is delimited by an upper limit value $L_u$ and by a lower limit value $L_L$ and is centered on the median M. Finally, the mean value $\alpha_{medio}$ of all engine angle values, which are included in the range delimited by the upper limit value $L_u$ and by the lower limit value $L_L$, is calculated.

The angle expressed in engine degrees corresponding to the closing of the exhaust valve 13, is equal to the difference between the previously calculated mean value $\alpha_{medio}$ and a contribution imputable to the transmission delay Δt due to the propagation of sound.

The method used by the control unit 21 for calculating the transmission delay Δt due to the propagation of sound is described below.

During a preliminary design phase, as shown in FIG. 3, the distances d1-d4 existing between microphone 22 and each exhaust valve 13, the movement at a respective cylinder 2 of which it is intended to verify (i.e. the distance between 22 and member of the internal combustion engine 1 which impacts on a respective limit stop in a step of closing), are determined.

The transmission delay Δt is calculated by using the distances d1-d4, the speed of sound $V_{sound}$ and the rotation speed w of the camshaft 15; transmission delay Δt which is expressed in engine degrees and indicates the delay with which the microphone 22 hears the intensity S of the microphone signal generated in the internal combustion engine 1 by the investigated phenomenon, i.e. in this case by the closing of the exhaust valves 13.

Preferably, the transmission delay Δt expressed in engine degrees is calculated by applying the following equation, assuming that cylinder 2 is taken into consideration:

$$\Delta t=(d2/V\text{sound})*6*w$$

Where:

Δt [°] transmission delay expressed in engine degrees;

d2 [m] distance existing between microphone 22 and the element of the internal combustion engine 1, the movement of which it is intended control, i.e. the exhaust valve 13 of the cylinder 2;

w [rpm] rotation speed of the camshaft 15;

$V_{sound}$ [m/s] propagation speed of the sound in the air.

The signal related to the exhaust valve 13 of the cylinder 2A has a wider extension that the extension of the signals at the other cylinder 2B-2D, because cylinder 2A is closest to the microphone 22. Similarly, the signals related to the closing of the exhaust valves 13 of the cylinders 2B, 2C and 2D display gradually decreasing extensions because the exhaust valves 13 themselves are arranged at increasing distances d2, d3, d4 from the microphone 22.

At this point, it is thus possible to calculate the angle expressed in engine degrees corresponding to the closing of any exhaust valve 13 according to the following equation:

$$\alpha_{v_close}=\alpha_{medio}-\Delta t$$

Where:

Δt [°] transmission delay expressed in engine degrees;

$\alpha_{medio}$ [°] mean value $\alpha_{medio}$ of all engine angle values which are included in the range delimited by the upper limit value $L_u$ and by the lower limit value $L_L$;

$\alpha_{v_close}$ [°] closing angle of the exhaust valve 13.

According to a variant, the mean value $\alpha_{medio}$ of the instantaneous engine angle closing values of the exhaust valves 13 is calculated using the derived of the power signal measured by the microphone 22 over time.

According to a further variant, an emphasizer is applied to the band-pass filter of the intensity S of the microphonic signal in the analysis window Y, so as to emphasize the part of signal richest in information. The power of the resulting signal can thus be calculated and the method described above can be used to identify the closing instant of the exhaust valves 14 according to power.

The signal detected by the microphone 22 may be used also to determine the striking speed generated by the closing of the exhaust valves 13.

The energy E of the filtered signal with band-pass illustrated in FIG. 8 must be determined in order to detect the closing speed of the exhaust valves 13, i.e. the impact speed of the exhaust valve 13 itself.

The energy E of the microphonic signal S filtered with the band-pass is calculated by means of numeric integration of the filtered microphonic signal S itself. In particular, the filtered microphonic signal S taken into consideration is comprised in the analysis window Y (comprised between 5.5 and 8.5 kHz) which corresponds to the window of frequencies associable to the striking of the exhaust valves 13 which close and then impact against a respective limit stop producing a vibration. Furthermore, the filtered microphonic signal S which is taken into consideration is related to a time interval, which is of preset duration and is centered on the previously calculated closing angle $\alpha_{v_close}$ of the exhaust valve 13.

Figure 13:
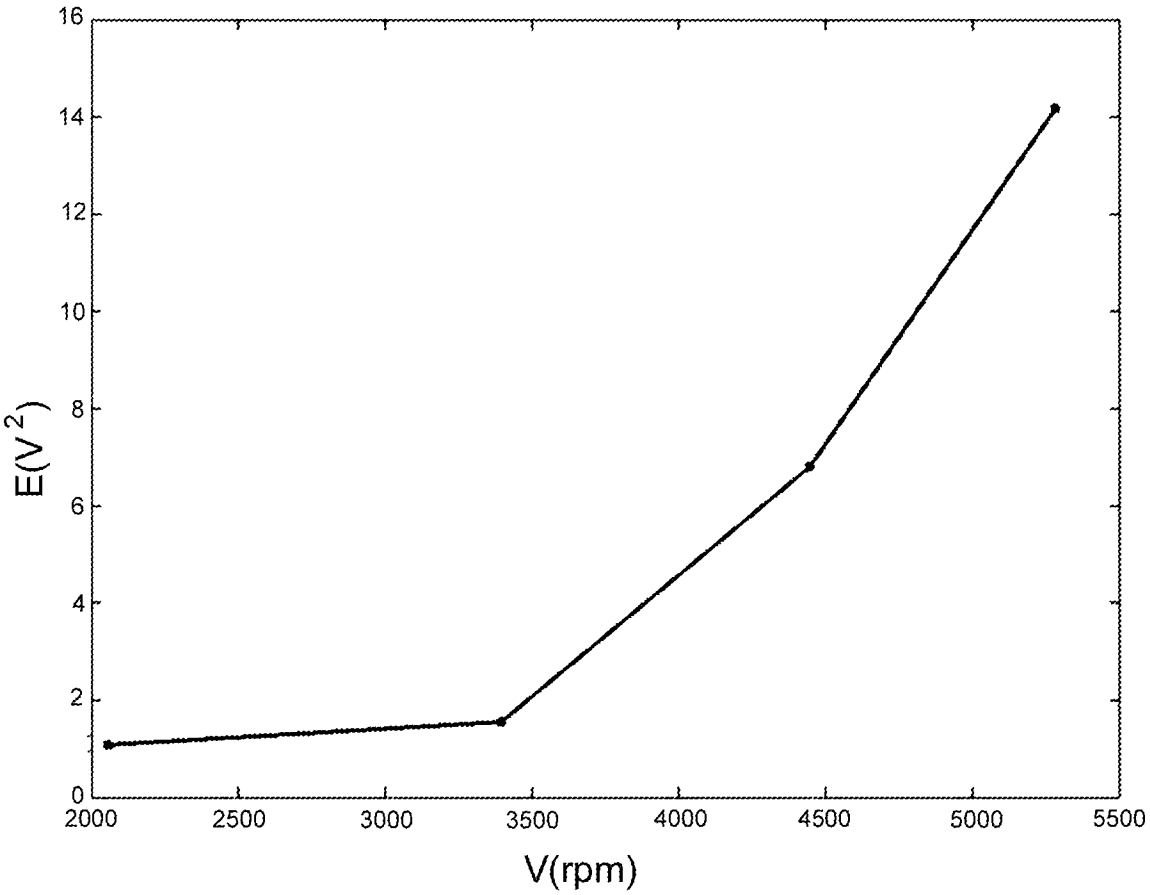
FIG. 13 is a graphic which illustrates the energy of the microphonic signal according to the speed of the internal combustion engine.

From the operative point of view, the energy E of the filtered microphonic signal S is correlated to the impact speed of the exhaust valve 13 on a respective seat: for example, in the case of engine with camshaft, the speed is proportional to the RPM of the internal combustion engine 1, as shown in FIG. 13. It is indeed known that the opening and closing ramps of the valves are at constant speed according to the camshaft angle and thus proportional to the rotation speed of the internal combustion engine 1. In particular, the experimental law of the energy E of the microphonic signal S filtered at the impact speed of the exhaust valve 13 on a respective seat is essentially quadratic (or rather cubic).

In a preliminary design phase, the preferably bi-univocal function is determined which correlates the energy E of the microphonic signal S filtered by the impact speed of the exhaust valve 13, e.g. as mean of several acquisitions, which may be installed in the electronics control unit 21.

In order to detect the impact or closing speed of the exhaust valve 13, a number of cycles N is established in which to repeat the detection steps of the energy E of the filtered microphonic signal S to obtain the N values of the impact or closing speed of the previously identified bi-univocal function. N speed values are obtained after having repeated the N detection cycles, which N values are memorized in a memory buffer. The valve impact or closing speed is calculated as mean value of the N values: for example, as arithmetic average or by using the previously described median method for detecting the impact instant or timing of the exhaust valve 13.

According to a variant, an N number of cycles in which to repeat the detection operation of the energy E of the filtered microphonic signal S is established according to a variant for detecting the impact of closing speed of the exhaust valve 13. After having repeated the N detection cycles, N values of energy E are obtained, which are memorized in a memory buffer. The mean energy E is calculated as mean value of the N values of energy E detected above (e.g. as arithmetic mean or using the previously described median method). The correlation function previously identified for correlating the mean energy E and the impact or closing speed of the exhaust valve 13 is used in order to obtain the impact speed.

According to a further variant, the control method described hereto is capable of calculating the sound pressure and power levels (i.e. the acoustic pressure waves) detected by the microphone 2 and generated by the impact. During the design and set-up phase, at least one threshold value $V_{SPr}$ with which to compare the calculated sound pressure level and at least one threshold value $V_{SP}$ which with to compare the calculated sound power level are determined.

For example, the threshold values $V_{SPr}$ $V_{SP}$ may be established according to the noise perceived by the driver so as to diagnose excessive noisiness of the internal combustion engine 1 when the calculated pressure and sound values are higher than the predetermined threshold values $V_{SPr}$ $V_{SP}$. Obviously, a plurality of threshold values $V_{SPr}$ $V_{SP}$ could be provided, which indicate, for example, either the absence of noise produced by the internal combustion engine 1, or the presence of a modest, acceptable noise, or the presence of excessive, not supportable noise.

The method described hereto with reference to estimating the closing instant and speed of the exhaust valves 13 may also be used to estimate the instant and the closing of any other component of the internal combustion engine 1 which moves cyclically from an initial (opening or closing) position to a final opening or closing) position defined by a limit stop.

It is apparent that the extension of the frequency bands which identify the analysis window Y and the detection windows W, V etc. must be determined according to the component the closing instant and speed of which it is intended to be investigated.

After having determined the closing angle $\alpha_{v_close}$ of the exhaust valve 13, the value of the closing speed of the exhaust valves 13 and the sound pressure and power levels, one or more of these magnitudes can be used as feedback in a closed-loop control. In particular, the target mean values of these magnitudes representing the striking of the exhaust valve 13, i.e. the closing angle $\alpha_{v_close}$, the closing speed and the sound pressure and power levels can be determined in a preliminary design and set-up phase of the control system.

Such target mean values are compared with the detected values so as to obtain an error E which is used to determine the closed-loop contribution attempting to cancel the error E itself.

The description above is advantageously applied also to the control of the movement of components other than the exhaust valves 13 which move towards a position defined by a limit stop, without because of this loosing in generality: for example, the intake valve 10, for control solenoid valves as in an internal combustion engine of the type commercially known as "Multi-Air", for the fuel injector.

The control method may be implemented, for example, for controlling intake valves 10, for controlling position in a VVT (Variable Valve Timing) system of known type, for controlling camless engine valves, etc.

The control method described hereto for determining the closing instant and speed of a component that cyclically moves towards a position defined by a limit stop has many advantages because it is easy to implement also in an existing electronic control unit 21 without requiring a high additional computing burden. Furthermore, it is necessary to simply insert an omnidirectional microphone 22 inside the internal combustion engine 1 and to connect it to the electronic control unit 21.

Finally, the method allows to estimate with very high accuracy and confidence the instant impact and/or speed of impact of the component against the limit stop by analyzing the microphonic signal generated by the impact itself.

The invention claimed is:

1. A method for determining movement of a component that moves towards a position defined by a limit stop in an internal-combustion engine (1), the said method comprising the steps of:

controlling the arrangement of at least one acoustic microphone (22) at different decreasing distances with respect to and orientation of the acoustic microphone (22) toward the component so that intensity (S) of a signal generated by impact of the component against the limit stop can be detected by the acoustic microphone (22);

detecting, by the acoustic microphone (22), the intensity (S) of the signal generated by the impact of the component against the limit stop by sampling at high frequency, having a value in the order of size of 100 kHz, to acquire the intensity (S) of the signal generated by the impact of the component against the limit stop;

memorizing in a memory buffer, the intensity (S) of the signal generated by the impact of the component against the limit stop according to the engine angle detected by the acoustic microphone (22) during the operating cycle;

determining two detection windows (W, V) expressed in engine angle and having each a respective start engine angle (αw_start, αv_start) and a respective finish engine angle (αw_finish, αv_finish);

comparing the intensity (S) of the signal within the two detection windows (W, V);

determining the extension of an analysis window (Y) of the intensity (S) of the signal based on the comparison between the intensity (S) of the signal within the two detection windows (W, V), wherein start engine angle (αw_start) of the first detection window (W) corresponds to about a −15° engine angle with respect to an upper combustion top dead centre (TDC) of a respective cylinder (2) of the internal-combustion engine (1), wherein finish engine angle (αw_finish) of the first detection window (W) corresponds to about a +75° engine angle with respect to the top dead centre (TDC) such that the first detection window (W) is centered about the top dead centre (TDC), wherein start engine angle (αv_start) of the second detection window (V) corresponds to about a +75° engine angle with respect to the top dead centre (TDC) and substantially coincides with the finish engine angle (αw_finish) of the first detection window (W), and finish engine angle (αv_finish) of the second detection window (V) corresponds to about a +165° engine angle with respect to the top dead centre (TDC); wherein the second detection window (V) is a neutral detection window which covers an interval expressed in engine degrees remote from the impact of the component against the limit stop;

detecting, by the microphone (22), and memorizing the intensity (S) of the signal according to an engine angle and to the time within the analysis window (Y);

determining the at least one of the impact instant and impact intensity by analyzing the intensity (S) of the signal within the analysis window (Y);

determining a mean value of the at least one of the impact instant and impact intensity of the component against the limit stop; and determining an error (E) from the comparison between the mean value of the at least one of the impact instant and impact intensity of the component against the limit stop and at least one of the impact instant and impact intensity of the component against the limit stop;

controlling the movement of the component that moves toward a position defined by a limit stop by using the impact of the component against the limit stop as feedback in a closed loop control;

filtering the intensity (S) of the signal within the analysis window (Y) by a band-pass filter;

detecting and memorizing the energy (E) of the filtered signal within the analysis window (Y) in a time interval around the instant of the impact;

establishing a number (N) of cycles and a correlation law of the energy (E) of the filtered signal (S) with the impact speed of the component detecting and memorizing in the memory buffer a number (N) of values of the impact speed of the component obtained from the correlation with the energy (E) of the filtered signal (S) within the analysis window (Y), equal to the number (N) of cycles; and determining the impact speed of the component by using the mean of the values of impact speed obtained from the filtered signal within the analysis window (Y).

2. The method as set forth in claim 1, wherein the method further includes the steps of:

determining a distance (d) existing between the microphone (22) and the component the at least one of the impact instant and impact speed of which against the limit stop has to be determined;

calculating a transmission delay (Δt) expressed in engine angle according to a rotation speed (w) of a drive shaft (15) of the internal-combustion engine (1) and to the distance (d) existing between the microphone (22) and the component; and determining the at least one of the impact instant and impact speed of the component against the limit stop also according to the transmission delay (Δt).

3. The method as set forth in claim 2, wherein the transmission delay (Δt) expressed in engine angle is calculated by applying the equation $$\Delta t=[(d/V_{sound})*w]$$

and

Δt=transmission delay expressed in engine angle, d=distance existing between the microphone (22) and the component, w=rotation speed of the drive shaft (15), and $V_{sound}$=propagation speed of the sound in the air.

4. The method as set forth in claim 3, wherein the angle corresponding to the instant of the impact of the component against the respective limit stop is calculated by applying the equation $$\alpha_{v_close}=\alpha_{medio}-\Delta t$$

and

Δt=transmission delay expressed in engine angle, $\alpha_{medio}$=mean value of the angle corresponding to the moment of the impact calculated by analyzing the signal generated by the impact, and $\alpha_{v_close}$=angle corresponding to the impact of the component against the respective limit stop.

5. The method as set forth in claim 1, wherein the method further includes the step of:

carrying out a fast Fourier transform of the intensity (S) of the signal within the two detection windows (W, V), in order to determine the extension of the analysis window (Y).

6. The method as set forth in claim 1, wherein the method further includes the steps of:

filtering the intensity (S) of the signal within the analysis window (Y) by a band-pass filter; and calculating the at least one of the impact instant and impact speed by using the filtered intensity (S) of the signal within the analysis window (Y).

7. The method as set forth in claim 6, wherein the method further includes the step of:

emphasizing the signal filtered in the band of the band-pass filter by an emphasizing device.

8. The method as set forth in claim 6, wherein the method further includes the steps of:

detecting and memorizing the power (P) of the filtered signal within the analysis window (Y); and determining the instant of the impact based on the power (P) of the filtered signal within the analysis window (Y).

9. The method as set forth in claim 6, wherein the method further includes the steps of:

detecting and memorizing the power (P) of the filtered signal within the analysis window (Y); and determining the instant of the impact based on the derivative in time of the power (P) of the filtered signal within the analysis window (Y).

10. The method as set forth in claim 8, wherein the method further includes the steps of:

determining an upper threshold value (UTV) of the power (P) of the filtered signal within the analysis window (Y);

identifying the instants in which the power (P) of the filtered signal within the analysis window (Y) is higher than the upper threshold value (UTV); and determining the mean value of the instant of the impact of the component within the analysis window (Y) based on the power (P) values associated with the instants in which the power (P) of the filtered signal within the analysis window (Y) is higher than the upper threshold value (UTV).

11. The method as set forth in claim 10, wherein the method further includes the steps of:

determining the median (M) of the power (P) values associated with the instants in which the power (P) of the filtered signal within the analysis window (Y) is higher than the upper threshold value (UTV);

identifying an interval of values centered on the median (M); and calculating the mean value of the instant of the impact within the analysis window (Y) as mean of the power (P) values contained within the interval of values centered on the median (M).

12. The method as set forth in claim 1, wherein the method further includes the steps of:

detecting and memorizing the energy (E) of the filtered signal within the analysis window (Y) in a time interval around the instant of the impact; and determining the impact speed of the component by using the energy (E) of the signal within the analysis window (Y).

13. The method as set forth in claim 12, wherein the method further includes the steps of:

Establishing a number (N) of cycles and a correlation law of the energy (E) of the filtered signal (S) with the impact speed of the component;

detecting and memorizing in a memory buffer a number (N) of values of the impact speed of the component obtained from the correlation with the energy (E) of the filtered signal (S) within the analysis window (Y), equal to the number (N) of cycles; and determining the impact speed of the component by using the mean of the values of impact speed obtained from the filtered signal within the analysis window (Y).

14. The method as set forth in claim 13, wherein the method further includes the steps of:

determining the median (M) of the values of the impact speed of the component;

identifying an interval of values centered on the median (M); and calculating the mean value of the impact speed within the analysis window (Y) as mean of the values of impact speed contained within the interval of values centered on the median (M).

15. The method as set forth in claim 1, wherein the component is a valve (10, 13) of the internal-combustion engine (1) and the impact occurs in correspondence of the closing of said valve (10, 13).

16. The method as set forth in claim 1, wherein the method further includes the steps of:

detecting and memorizing at least one of sound power and sound pressure levels of the signal generated by the impact of the component against the limit stop;

establishing at least one threshold value ($V_{SP}$) for the sound power level of the signal and at least one threshold value ($V_{SPr}$) for the sound pressure level of the signal;

comparing the at least one of the sound power and sound pressure levels of the signal generated by the impact of the component against the limit stop with the respective threshold values ($V_{SP}$, $V_{SPr}$); and diagnosing the excessive noise of the internal-combustion engine (1), in case the calculated values of the at least one of the sound power and sound pressure of the signal generated by the impact of the component against the limit stop are higher than the respective predefined threshold values ($V_{SP}$, $V_{SPr}$).

* * * * *